US006793038B2

(12) United States Patent
Meller

(10) Patent No.: US 6,793,038 B2
(45) Date of Patent: Sep. 21, 2004

(54) METHOD AND APPARATUS FOR RESCUING OCCUPANTS FROM HIGH STRUCTURES USING REPLACEABLE CABLE CARTRIDGES AND DYNAMIC RESISTANCE DEVICE

(76) Inventor: Moshe Meller, Apt. 1505, 111-Yefe-Nof, Haifa (IL), 34454

( * ) Notice: Subject to any disclaimer, the term of this patent is extended or adjusted under 35 U.S.C. 154(b) by 0 days.

(21) Appl. No.: 10/210,236

(22) Filed: Aug. 1, 2002

(65) Prior Publication Data

US 2003/0070873 A1 Apr. 17, 2003

Related U.S. Application Data

(63) Continuation-in-part of application No. 10/011,913, filed on Nov. 6, 2001, now Pat. No. 6,550,576.

(60) Provisional application No. 60/329,390, filed on Oct. 15, 2001, provisional application No. 60/329,935, filed on Oct. 16, 2001, and provisional application No. 60/335,886, filed on Oct. 26, 2001.

(51) Int. Cl.[7] ..... A62B 1/06; A62B 1/08; B65H 23/04

(52) U.S. Cl. ..... 182/73; 182/231; 242/396.9

(58) Field of Search ..... 182/193, 191, 182/73, 5, 192, 234, 70, 236, 231; 248/208; 188/187, 189, 65.1, 65.2, 65.3, 180, 185; 254/389–391, 405, 160, 157, 158, 159; 242/396.5, 396.9, 423, 423.1

(56) References Cited

U.S. PATENT DOCUMENTS

| | | | | |
|---|---|---|---|---|
| 309,141 A | | 12/1884 | Good | |
| 319,888 A | | 6/1885 | Dittrick | |
| 1,490,524 A | | 4/1924 | Wood | |
| 3,035,665 A | * | 5/1962 | Gauley | 188/136 |
| 3,198,880 A | | 8/1965 | Toulon | |

(List continued on next page.)

OTHER PUBLICATIONS

Rotary Vane Air Compressor, Model 6066 Series, manufactured by GAST Manufacturing Inc., Benton Harbor, MI 49022, Air Compressors Catalog 1998, p. 3, no month available.

Regenerative Blower, Regenair® R7 Series, Model R7 100A–2, manufactured by GAST Manufacturing Inc., Benton Harbor, MI 49022, Air Compressors Catalog 1998, pp. 109 and 127, no month available.

*Primary Examiner*—Blair M. Johnson
*Assistant Examiner*—Hugh B. Thompson
(74) *Attorney, Agent, or Firm*—Frishauf, Holtz, Goodman & Chick, P.C.

(57) ABSTRACT

A rescue method and apparatus for rescuing or evacuating occupants from high rise buildings or other high structures includes a frame adjacent an escape portion of the high structure; a dynamic resistance device such as an air fan mounted to the frame; and a removable and replaceable cable cartridge, having a pre-wound cable, which is removably and non-rotatably coupled to a rotatable portion of the dynamic resistance device. The cable is connectable to a person to be evacuated. When the person to be evacuated goes out from the escape portion of the high structure, his descending motion causes the cable to unwind with the same linear speed as the descending speed of the person, thus causing the rotatable portion of the dynamic resistance device to rotate and to create resistance to the descending speed of the person, until the descending speed of the person reaches a substantially equilibrium value. After a first person is evacuated, a new cable cartridge is mounted to the dynamic resistance device and the cable thereof is connected to a next person to be evacuated.

20 Claims, 7 Drawing Sheets

U.S. PATENT DOCUMENTS 3,602,483 A * 8/1971 Russell et al. ..... 188/184
3,844,377 A * 10/1974 Wilkins ..... 182/73
3,861,496 A 1/1975 Hoover
3,900,081 A * 8/1975 Dunston ..... 182/73
3,946,989 A * 3/1976 Tsuda ..... 182/241
4,000,881 A * 1/1977 Matsumoto ..... 182/241
4,029,298 A * 6/1977 Lassche ..... 182/238
4,469,196 A 9/1984 Sadler
4,640,388 A * 2/1987 Walborn ..... 182/231
4,722,422 A * 2/1988 Hiraoka ..... 182/233
4,949,812 A * 8/1990 Arthur et al. ..... 182/234
5,483,849 A * 1/1996 Orii et al. ..... 188/184
5,913,383 A 6/1999 Tseng
6,328,129 B1 * 12/2001 Ferguson ..... 182/70

* cited by examiner

METHOD AND APPARATUS FOR RESCUING OCCUPANTS FROM HIGH STRUCTURES USING REPLACEABLE CABLE CARTRIDGES AND DYNAMIC RESISTANCE DEVICE

This application is a Continuation-In-Part of Ser. No. 10/011,913 filed Nov. 6, 2001, now U.S. Pat. No. 6,550,576, the entire contents of which are incorporated herein by reference.

This application also claims the benefit of U.S. Provisional Application No. 60/329,390 filed Oct. 15, 2001; 60/329,935 filed Oct. 16, 2001; and No. 60/335,886 filed Oct. 26, 2001, the entire contents of which are incorporated herein by reference.

BACKGROUND OF THE INVENTION

This invention relates to a rescue method and apparatus for rescuing occupants from high structures such as high rise buildings, which is highly reliable, always ready to be used, with no preparation, which can rescue many people within a short time, for example, at a time of a fire, and which requires no power supply.

The problem of rescuing trapped people from high rise buildings at the time of a fire, explosion, etc., is well-known and has been reemphasized tragically by the events of Sep. 11, 2001. Most of the known rescue systems, such as emergency stairs or fire fighter ladders, cannot be used in the event of major fires, because the flights of emergency stairwells will catch fire first, and fire fighter ladders are not high enough and cannot cross the fire zone.

Various systems are known for rescuing occupants from high-rise buildings. One such system, disclosed in U.S. Pat. No. 3,198,880, utilizes a fan mechanism to which a cable is connected. However, this system requires rewinding of the cable after each escape. This is time consuming and impractical when being used for evacuating a large number of people from a high-rise building.

Another system using a fan is disclosed in U.S. Pat. No. 4,469,196. This system dispenses the cable only once, and has no provisions for renewing the cable.

Another single-use device is disclosed in U.S. Pat. No. 3,861,496. This system is relatively complex and does not provide for multiple use and therefore cannot rescue many people from a high-rise building within a short period of time.

OBJECTS OF THE INVENTION

An object of the present invention is to provide a reliable, simple to operate, rescue system that will save many people's lives at the time of major fires or other disasters.

Another object of the invention is to provide such a rescue system which can rescue a large number of people from high structures such as a high-rise building in a relatively short period of time.

Still another object of the invention is to provide such a rescue system having replaceable cable cartridges which are relatively inexpensive and which can be quickly changed after a person has been rescued, at a high repetition rate.

Yet another object of the invention is to provide such a rescue system which will enable crossing of a fire zone, especially in high-rise buildings.

Still another object of the invention is to provide such a rescue system which takes up little space, and which is economical to manufacture, install and maintain.

SUMMARY OF THE INVENTION

A rescue system according to the present invention comprises a frame which is preferably connected to the floor or other structure of a building or other high structure, near an escape portion of the building or other high structure, which escape portion is open or can be easily opened or broken at the time of a fire or other emergency situation that requires evacuation of occupants from the structure; and a fan having a shaft and at least two vanes connected to the shaft. The shaft is rotatably connected to the frame so that fan rotates freely relative to the frame. The shaft coupled to the fan has a connecting portion which removably and non-rotationally connects to a replaceable cable cartridge. The cable cartridge comprises a spool with a coupling portion which mates with the connecting portion of the shaft so as to removably engage the shaft and rotate together with the shaft. That is, the shaft and the spool are interconnected with each other so that they are non-rotatable relative to each other and so that the spool is easily removable after use. A rolled cable (preferably a steel cable of about 3 mm diameter and having a length of at least the height of the building) is wound on the spool which is removably engagable with the connecting portion of the shaft. A rescue belt or harness (such as used in rock climbing, parachuting or the like, for example) is removably connected to the free end of the rolled cable.

At the time of a fire or other emergency, the persons to be rescued wear the rescue belt or harness, a first cable cartridge is engaged on the connecting portion of the shaft and the free end of the cable is hooked or otherwise engaged with the rescue belt or harness. The first person jumps or slides out from the escape portion of the structure, and the falling person causes the fan to rotate (via the spool and shaft). The falling speed of the person is limited by the resistance of the rotating fan. The maximum falling speed can be limited to, for example, about 8 m/sec. (which is about equal to the free falling speed from a height of about 3.2 meters). Higher or lower falling speeds can be achieved and used by, for example, appropriately adjusting the fan blades, the size and number of the fan blades and the diameter of the spool of the cable cartridge.

When the first rescued person reaches the ground, the cable becomes loose and the spent cable cartridge can be removed from the shaft (by pulling same up, for example) and the spent spool can be replaced by a new one. The second person's rescue belt or harness is hooked to the free end of the cable of the new cable cartridge and he/she jumps or slides out from the escape portion of the structure. This process is repeated until the last person is rescued.

The fan (dynamic resistance device) can be replaced by other dynamic resistance devices, and/or a transmission can couple the rotation of the spool of the cable cartridge thereto.

DETAILED DESCRIPTION

The following detailed description is given with respect to escape and/or evacuation from high-rise buildings. However, the rescue systems of the present invention are useful not only for high-rise buildings, but also for boats, control towers, high chimneys, storage tanks and other high structures. The systems of the present invention can also be used for escape and/or evacuation of people or large articles from aircraft such as, for example, helicopters, for example, when a helicopter is hovering over a place to which persons or articles are to be evacuated.

Figure 1:
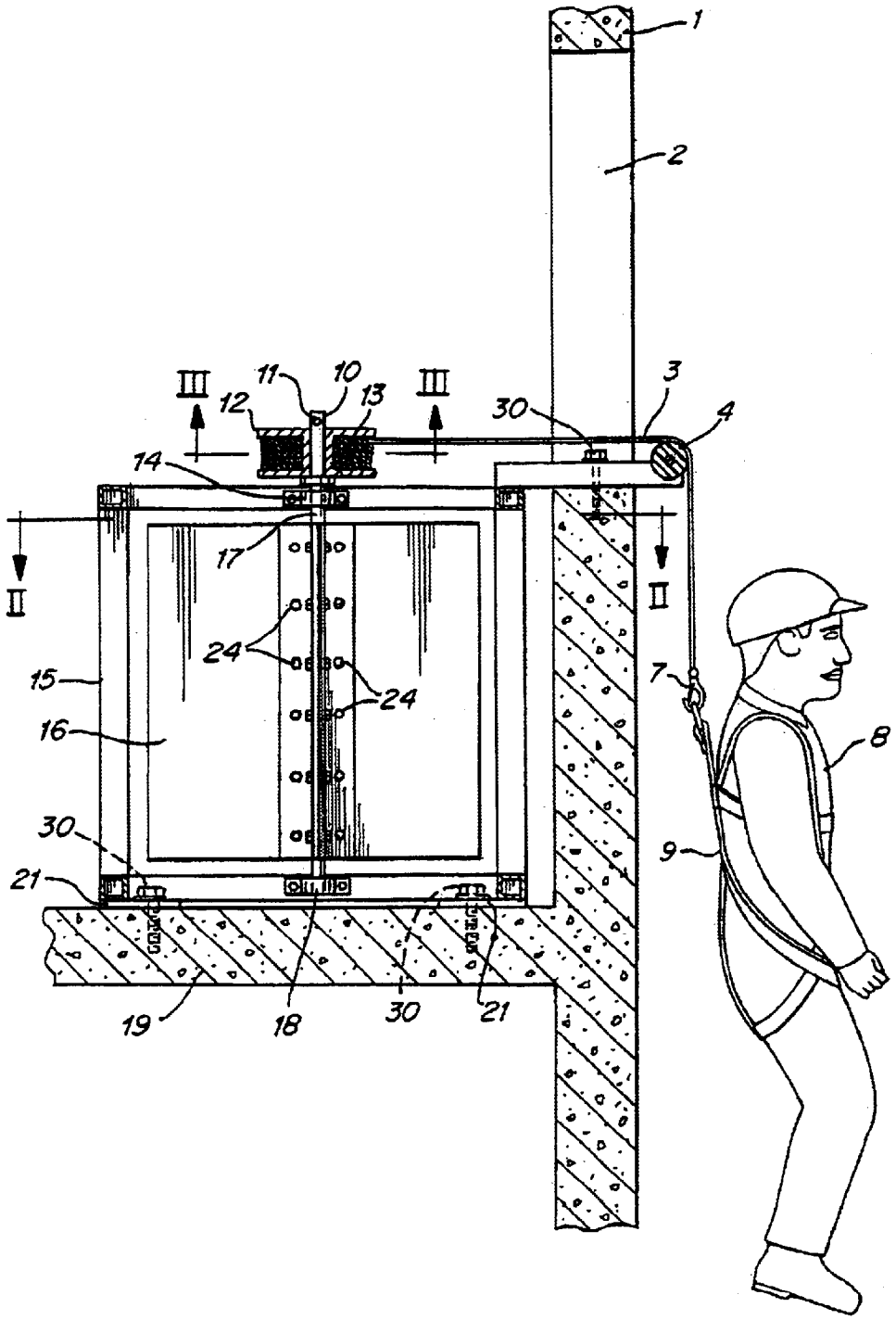
FIG. 1 is a sectional view of a rescue system according to the present invention taken along line I—I in FIG. 2, with additional elements and a person being shown in FIG. 1.
Figure 2:
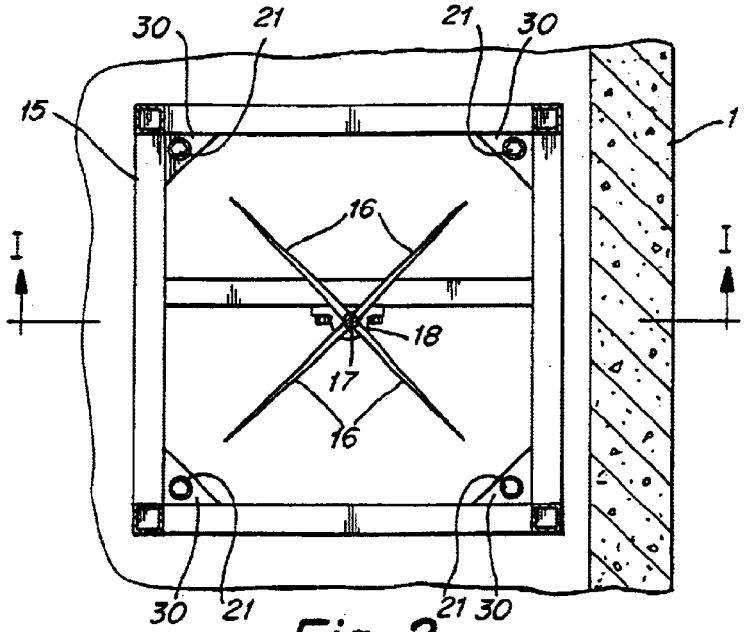
FIG. 2 is a sectional view thereof, taken along line II—II in FIG. 1.

Referring to FIGS. 1 and 2, the rescue system of the present invention comprises a main frame 15, preferably made of steel or stainless steel, preferably from profiled steel members such as hollow square □ steel members. The frame elements of frame 15 can be welded together. The main frame 15 is shown as rectangular in shape. Other shapes could be used. The main frame 15 is positioned on the floor 19 against the building's wall 1 near a window 2 that can be opened or broken to the outside at the time of a fire or other emergency requiring evacuation of the building. The main frame 15 is preferably fixed to a building structure such as the floor of the building or a building wall using concrete screws 30 and connecting plates 21 or by other anchoring members. An air fan (dynamic resistance device) comprises air fan blades 16 coupled to a fan shaft 17 which is mounted to the main frame 15 through an upper bearing 14 and a lower bearing 18. The air fan has at least two fan blades and preferably has four blades 16 as shown in FIG. 2. The fan can have three blades or any other desired number. The blades can be connected to the fan shaft by screws or pins or rivets 24 (see FIG. 5) or the like.

Figure 6:
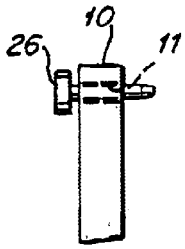
FIG. 6 shows the upper end of the fan shaft with a safety pin inserted therein.

The bearings 18 and 14 are preferably ball bearings and provide a free rotational motion to the fan. The upper end 10 of the fan shaft 17 extends out from the upper level of the main frame 15. This extending section 10 of the fan shaft 17 preferably has a square or rectangular shape and has a hole 11 therethrough to be used to receive a removable safety pin 26, as shown in FIG. 6.

In a typical example, the general dimensions of the main frame of a rescue system of the present invention are preferably about:

100 cm wide×100 cm long×100 cm high.

The preferred dimensions of each fan blade are about 90 cm high×50 cm wide so that the total active area of a 4 blades air fan is: $90\times50\times4=18{,}000\ cm^2=1.8\ m^2$. The upper end 10 of the air fan shaft 17 is non-round, i.e., in the shape of a square or rectangle, to provide removable non-rotatable engagement between said shaft 17 and the cable cartridge 12. Other non-round shapes as hexagonal, triangle, oval or any other irregular mating shapes are possible.

Figure 4:
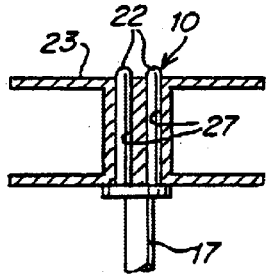
FIG. 4 is a detailed sectional view of another possible connection between the cable cartridge and the air fan shaft of the present invention.

FIG. 4 shows another type of engagement system between the upper portion 10 of the air fan's shaft and the cable cartridge 12 in which two or more pins 22 extend upwardly from the upper end of shaft 17 and engage into respective holes 27 in the cartridge spool 23. The two pins 22 extend from the upper end 10 of the air fan's shaft 17. The cable cartridge 23 has two holes 27, that receive the respective pins 22, which provides the removable and non-rotatable engagement between the cable cartridge 23 and the air fan's shaft 17. Any other type of removable connection which prevents the cartridge from rotating relative to the shaft 17 of the fan can be used.

Figure 7:
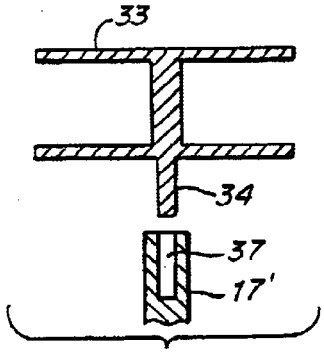
FIG. 7 shows another interconnection between the fan shaft and the removable cartridge.

Other connection techniques for connecting the cable cartridge to the fan shaft can be used. For example, as shown in FIG. 7, the cartridge 33 (which is similar to the other cartridges disclosed herein) has a shaft portion 34 extending therefrom, which is non-round (for example square, rectangular, etc.). The fan shaft 17' (similar to the fan shaft 17 described hereinabove) has a mating opening 37 at the upper end thereof which removably receives the projecting portion 34 of the cartridge 33 in a non-rotatable manner. That is, projecting portion 34 mates with receptacle 37 so as to provide a non-rotational coupling between shaft 17' and cartridge 33. In still another embodiment, member 34 of FIG. 7 could be round (or any other shape) and opening 37 could be round (or any other shape), and a pin (such as pin 26 of FIG. 6) could be provided which projects laterally through the upper end of the shaft 17' and through the member 34 so as to lock members 34 and 17' together in a non-rotational manner. To remove the cartridge after use, the pin must be pulled out, a new cartridge must then be installed and the pin must be replaced. This technique is more complex and may slow down the operation of replacing used cartridges.

Figure 5:
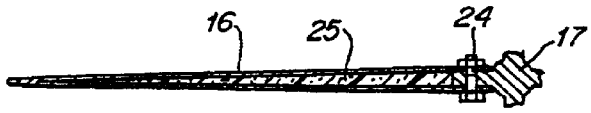
FIG. 5 is a detailed sectional view of an air fan blade of the present invention.

FIG. 5 shows in detail a possible construction of an air fan blade 16 and its connection to the air fan shaft 17. The fan blade outer surface 16 is preferably made from steel (or other metal) sheets 16. A plastic filling 25, which can be a strong plastic material such as polyurethane material or the like is filled between the steel (or other metal) sheets 16. Pins, screws or rivets 24 provide the connection between the blade 16 and the projecting connection members of the air fan shaft 17.

FIG. 1 shows the cable cartridge 12 engaged to the square end 10 of the air fan shaft 17. The rolled cable 13 is wound on the cable cartridge housing 12. The cable 13 is preferably made from steel wire, preferably about 3 mm in diameter. Other materials (such as nylon) and other diameters can be used, so long as the cable has sufficient strength to safely support a person. The cable 13 is connected at one end to the cartridge housing 12, while the other free end is connected to a safety hook 7, such as the type that is used in rock climbing, parachuting or the like.

At the time of a rescue operation, after the cable cartridge 12 is engaged with the shaft 11, the hook 7 is connected to the rescue belt or harness 9 of the person 8, and then the cable is put out over a guiding roller 4 (connected to the main frame 15 or to the building) and the person to be rescued goes out from the window. The free end of the cable, if desired, can be pre-connected directly to a belt or harness 9.

When the rescued person 8 starts to fall downwardly, his motion causes the cable 13 to move at the same speed and thus causes the cable cartridge spool to rotate accordingly (depending upon its diameter) in order to provide the needed linear dispensing speed to the cable 13. The rotation of the cable cartridge spool causes the air fan to rotate. In the embodiment of FIG. 1, the rotation speed of the air fan is the same as that of the cable spool, and the linear speed of the air fan blades is higher than the linear speed of the dispensing cable.

The following equation can be used to calculate these speeds:

$$\frac{Vblade}{Vcable} = \frac{Rblade}{Rcable}$$

where:

Vcable—is the linear speed of the downwardly falling rescued person

Vblade—is the linear speed of the outer (peripheral part of the fan blade).

Rcartridge—is the radius of the rolled cable 13 in the cartridge housing 12.

Rblade—is the radius to the outer part of the fan blade.

$$Vblade = \frac{Rblade}{Rcable} \times Vcable$$

if the ratio $$\frac{Rblade}{RCable} = 6$$

then Vblade=6×Vcable.

If the falling speed of the person is 8 meters/sec.=Vcable, then Vblade=6×8=48 meters/second.

At this speed level (Vblade=about 48 meters/second), the air fan provides enough resistance to keep the falling speed substantially constant.

At this falling person speed of about 8 m/sec, the rescued person can land on the ground safely. A lower or higher speed, can be used. When the first rescued person has landed on the ground, the cable becomes loose (slack) and the cable cartridge 12 can be replaced by a new cable cartridge, and next person is then connected to the cable of the new cable cartridge and is then rescued. This process is repeated until all persons are rescued. Of course, a suitable number (at least as many as the number of people at risk and which should be evacuated) of new cable cartridges are provided and preferably stored in close proximity to the main frame 15 for quick and easy access in an emergency situation.

A typical example for the rescuing rate is as follows:

H=height of the Building=200 meters.

Vcable=falling speed of person=8 m/sec.

TRep.=Time to replace a new cable cartridge=5 sec.

Tconn.=Time to connect the rescued person=5 sec.

The time ($T_N$) to rescue 20 people (N=20) will be:

$$T_N = N\left(\frac{H}{Vcable} + TRep. + TConn.\right) =$$

-continued $$T_{20} = 20\left(\frac{200}{8} + 5 + 5\right) = 700 \text{ sec.} = 11.66 \text{ min.}$$

20 people can be rescued within less than 12 minutes.

Figure 8:
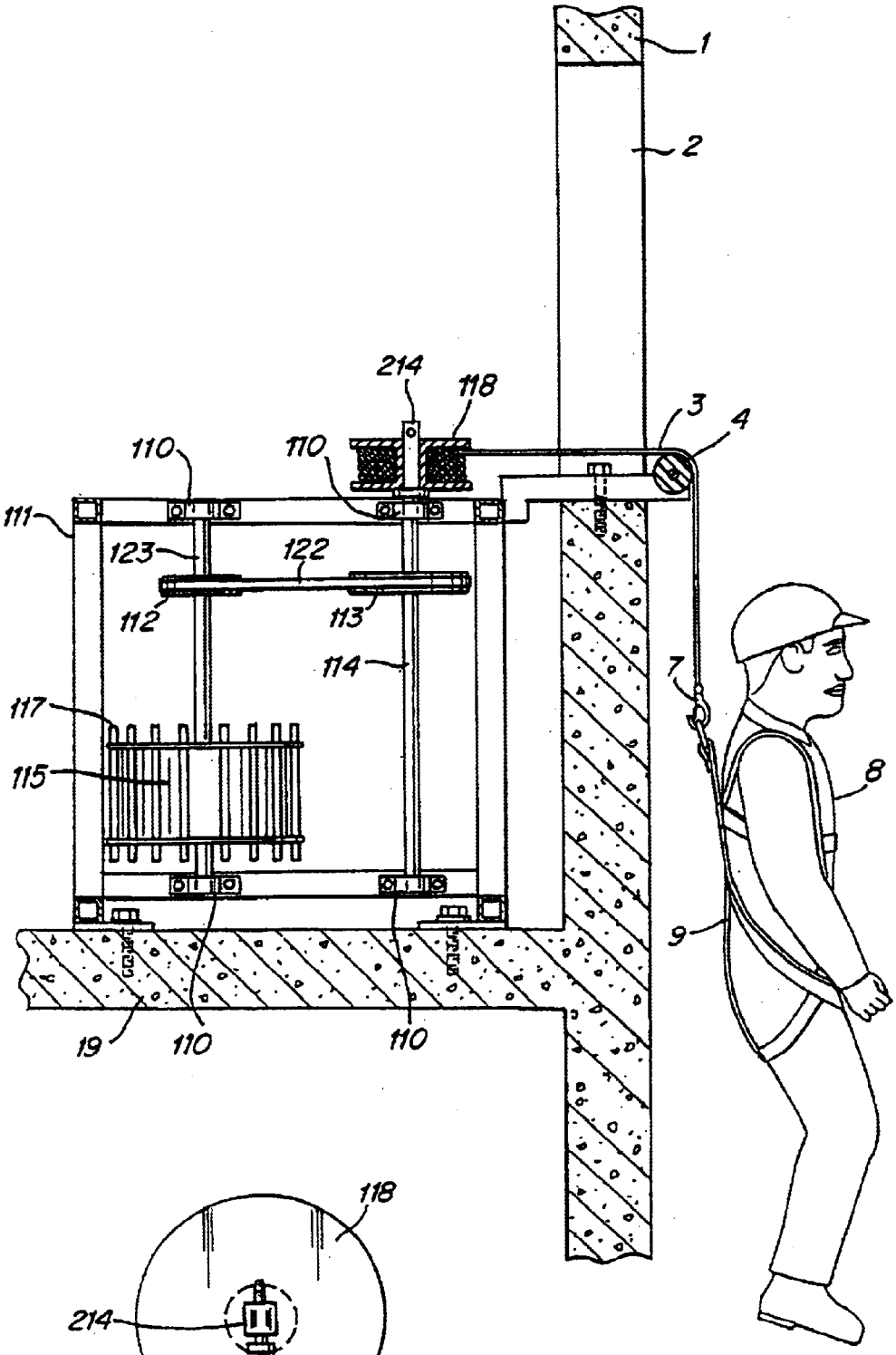
FIG. 8 is a sectional view, similar to FIG. 1, showing another embodiment of the invention.
Figure 9:
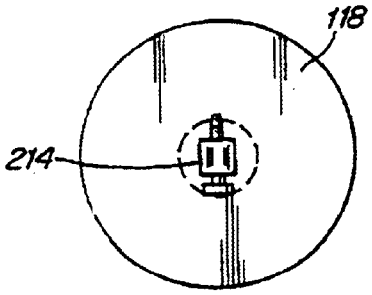
FIG. 9 is a top view showing the engagement between the shaft and the cable spool.

According to a second embodiment of the invention shown in FIGS. 8 and 9, rotatable fan 16 is replaced by a mechanism including a dynamic resistance mechanism 15 which can be an oil pump, centrifugal brake system, a water pump, an electric generator, air blower or the like. The dynamic resistance mechanism 15 provides a resistance to rotation which is a function of its rotational speed. That is, the higher the rotation speed, the higher will be the resistance to rotation of the dynamic resistance mechanism. The construction of an apparatus using a dynamic resistance is described below.

Referring to FIG. 8, shaft 114 is connected to the frame 111 through bearings 110 (preferably ball bearings) which allow the shaft 114 to rotate relative to the frame 111. One end 214 of the shaft 114 has a shape which allows the cable cartridge 118 to be removably engaged so that the spool of the cable cartridge 118 is non-rotatable relative to the shaft 114. The shape of the end 214 of the shaft 114 is preferably square or rectangular but any other shape or form (such as hexagonal, triangular, etc.) which allows removable engagement between end 214 and cartridge 118, can be used. The opening of the cable cartridge has a mating shape to provide the non-rotational engagement. The safety pin arrangement of FIG. 6 can be used with the embodiment of FIGS. 8 and 9.

The shaft 114 is connected to the dynamic resistance device 115 through a transmission 112, 113, 122. The transmission 112, 113, 122 can be made of gears, belt-and-pulleys (as shown in FIG. 8), or the like. The belt-and-pulley arrangement of FIG. 8 comprises pulleys 112, 113 connected together by a belt 122. The transmission 112, 113, 122 preferably has a drive ratio which increases the rotational speed of the dynamic resistance device 115 relative to shaft 114. A large heat sink 117 is attached to dynamic resistance device 115 to provide cooling to the dynamic resistance device 115 so as to prevent overheating.

A typical cooling rate which is needed from the heat sink 117 is mgv, where m=mass of the rescued person (for example, about 100 Kg), g=9.8 (gravity), and v=falling speed of rescued person=8 m/sec.

$$mgv = 100\ kg \times 9.8 \times 8\ m/sec. = 7{,}840\ watts = 7.84\ kw.$$

At the time of fire or other emergency evacuation from the building, the person 7 to be rescued wears the rescue belt 9, the cable cartridge 118 is engaged to the shaft 114, and the cable hook 5 is hooked to the rescue belt 9. The first person jumps or slides out of the window, his falling causes the cartridge 118 and the shaft 114 to rotate, the transmission 112, 113, 122 causes the dynamic resistance device 115 to rotate, and the falling speed is limited by the resistance of the dynamic resistance device 115. The limited falling speed can be about 8 meters/sec, as in the first example above, but higher or lower speeds can be achieved and used.

When the first person lands on the ground the cable 3 becomes loose or slack and the cable cartridge 118 can be replaced and the next person can be hooked to the new cable 3 and rescued. This process will be repeated until the last person will be rescued.

Figure 10:
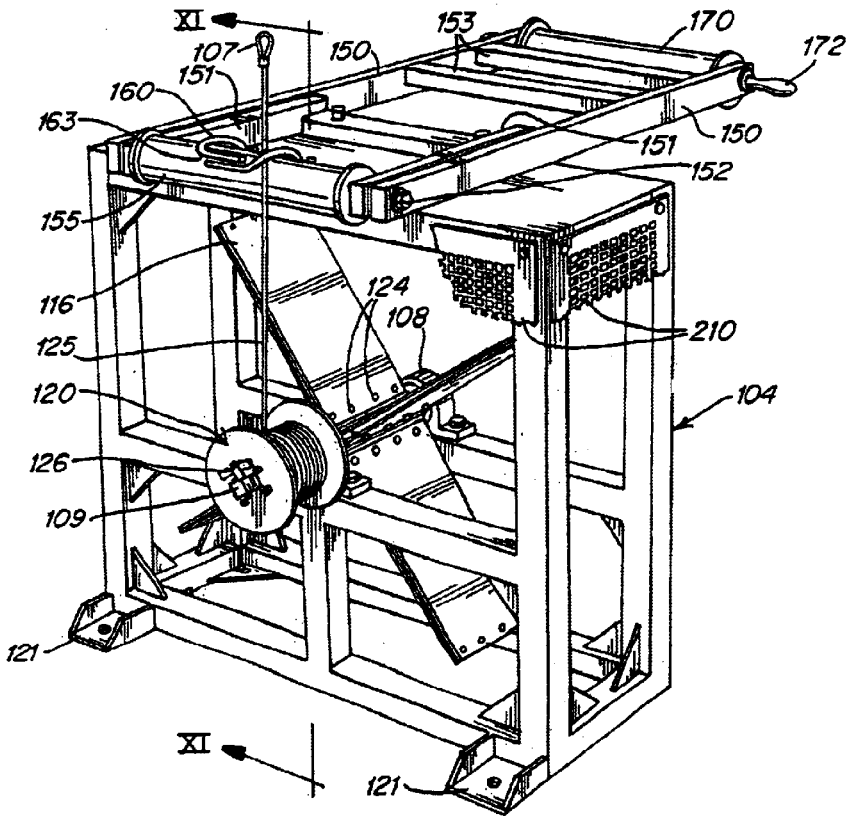
FIG. 10 is a perspective view of another embodiment of a rescue system according to the present invention.
Figure 11:
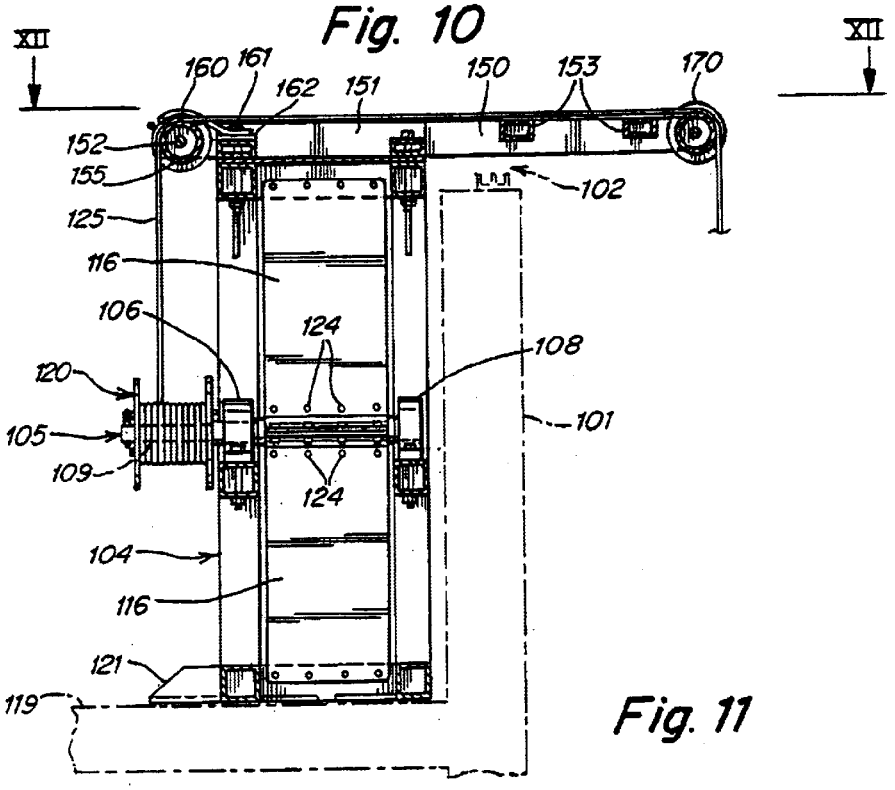
FIG. 11 is a sectional view thereof taken along line XI—XI in FIG. 10.

Another embodiment of the invention, as shown in FIGS. 10–16, comprises a main frame 104 which is generally rectangular in shape, and is made of hollow square steel members which are welded together. Other shapes and other shapes of the steel members could be used. For example, circular, oval or L-shaped steel members could be used to fabricate the frame 104. As shown in FIG. 11, the main frame 104 is positioned on the floor 119 against the building's wall 101 near a window 102 that can be opened or broken to outside at the time of a fire or other emergency requiring evacuation of the building. The main frame 104 is preferably fixed to a building structure such as the floor of the building or a building wall using screws (such as screws 30 shown in FIG. 1) and connecting plates 121, or by other anchoring members.

An air fan (dynamic resistance device) comprises air fan blades 116 coupled to a fan shaft or axle 105 which is mounted to the main frame 104 through a front bearing 106 and a rear bearing 108. The air fan has, in the embodiment shown in the drawings, four fan blades 116. However, the fan may have less than four or more than four blades, as desired, depending upon the application. The blades are connected to the fan shaft by screws or pins or rivets 124, or the like.

Figure 3:
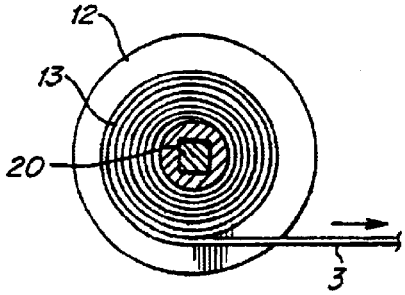
FIG. 3 is a sectional view of the cable cartridge, taken along line III—III in FIG. 1.

The bearings 106 and 108 are preferably ball-bearings and provide a relatively free rotational motion to the fan. The forward end 109 of the fan shaft 105 extends out from the forward portion of the main frame 104. This extending section 109 of the fan shaft preferably-has a square or rectangular profile (see FIG. 3) and has a hole (such as hole 11 in FIG. 6) therethrough to be used to receive a removable safety pin 126, such as pin 26, shown in FIG. 6.

In a typical example, the general overall dimensions of the main frame of the rescue system of the present invention are preferably about: 35 centimeters wide by 85 centimeters long by 85 centimeters high.

The preferred dimensions of each fan blade are about 18×40 cm.

In the system of FIGS. 10–16, the cable cartridge 120 is engaged to the square end 109 of the air fan shaft 105, as shown in FIGS. 10 and 11. The cable 125 is wound on the cable cartridge housing, and it is fed out, as shown in FIGS. 10 and 11. The cable 125 is preferably made from steel wire, preferably about 3 mm in diameter. Other materials (such as nylon) and/or other diameters can be used, so long as the cable has sufficient strength to safely support a person using the escape system. The cable 125 is connected at one end to the cartridge housing 120, whereas the other free end has a loop or other connection portion 107 for connection to a safety hook or the like which is connected to the person using the escape system, such as shown in FIG. 8.

The system further comprises a pair of cable platform arms 150 which are pivotally connected to support arms 151 which in turn are fixedly connected to the top surface of the main frame 115. The pivotal connection is, for example, accomplished by means of a long shaft 152 which passes through holes in the platform arms 150 and support arms 151. Between the support arms 151 is arranged a roller 155 which is rotatably mounted on the long shaft 152. A cable guide 160 is secured to the top surface of the main frame 115, for example by bolts 161. The cable guide 160 is mounted to a plate 162, which connects to the top surface of the frame 115 via bolts 161. At the opposite end of the platforms arms is rotatably mounted another roller 170, with handles 172 at opposite ends thereof (see FIG. 12). Additional cross-support members 153 are provided between platform arms 150. Members 153 provide support for a person on the unit during preparation for escape. A person can sit on the unit during preparation for escape.

Figure 12:
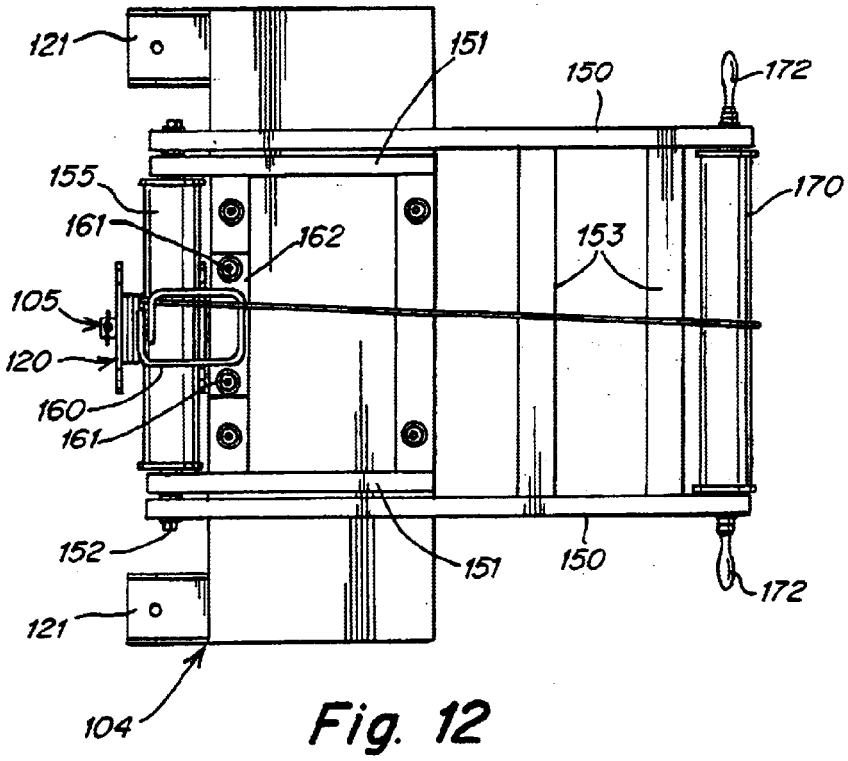
FIG. 12 is a top sectional view thereof taken along line XII—XII in FIG. 11.
Figure 13:
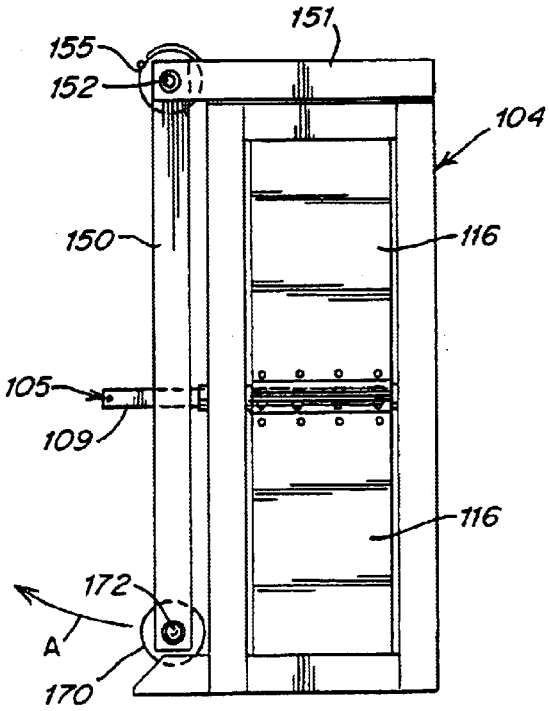
FIG. 13 is a side view thereof.

When the system is not in use, the platform arm assembly is pivoted so that it rests against the front portion of the main frame 115, as shown in FIG. 13. When the system is to be used, the platform arm assembly is swung upwardly in the direction of the arrow A in FIG. 13 to assume the position shown in FIGS. 10–12. Then, a cable cartridge 120 is mounted to the shaft portion 109 and locked thereon by means of a locking pin 126 or the like. The cable is then fed upwardly through the cable guide 160 and around roller 155. A person to be rescued is connected to the loop 107 of the cable and climbs on top of the platform arm assembly, and goes through the window and over the outer roller 170, which further guides the cable thereon. The person then drops to safety, as described hereinabove. FIG. 12 shows the cable passing over both rollers 155 and 170, in a "use" condition.

After one person escapes, the cable cartridge 120 is removed from the shaft portion 109 and a new cable cartridge is mounted thereon, and the next person to be rescued is connected to the free end of the cable.

Figure 14:
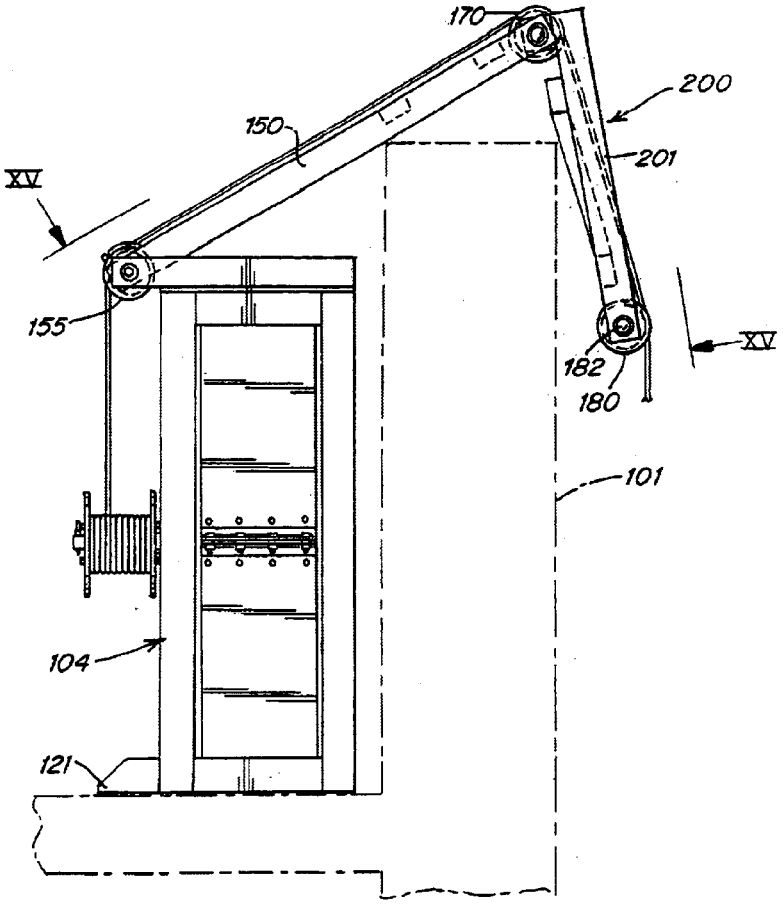
FIG. 14 is a side view thereof in the state of use, where the cable is being payed out to the outside of a building.
Figure 15:
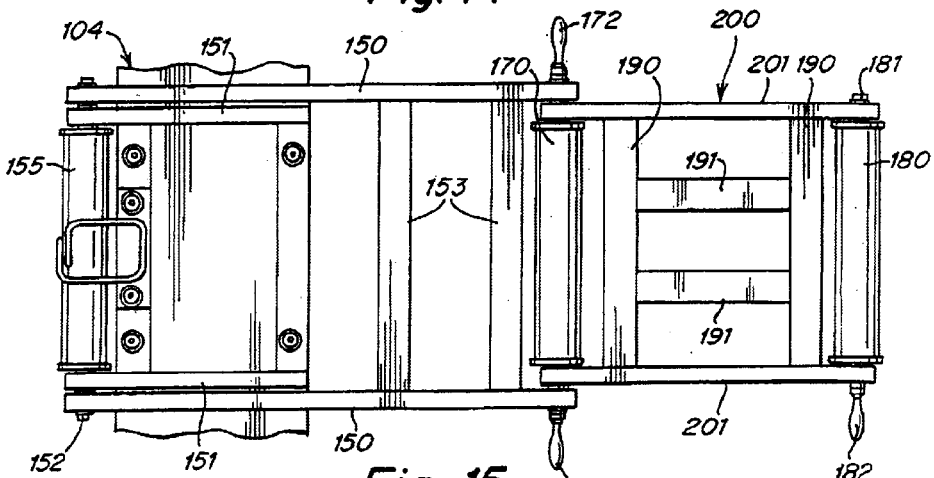
FIG. 15 is a top view with the cable support and guide system extended.
Figure 16:
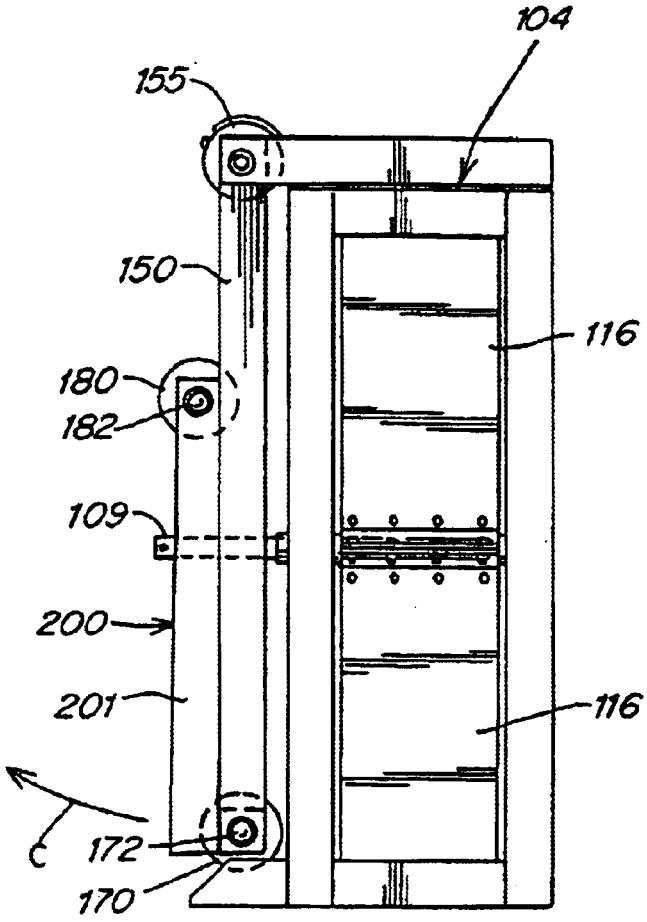
FIG. 16 is a side view with the cable support and guidance system in a folded position in the out-of-use state.

In situations where the window opening is high, or where the rescue system must be placed spaced from the outer wall of the building, an arrangement such as shown in FIGS. 14–16 is used. In this arrangement, the platform arm assembly includes an additional arm assembly 200 which comprises extension arms 201 which are pivotally connected to the bolt mounting roller 170, and has a further roller 180 at the free end thereof. The roller 180 is mounted to the extension arms 201 by means of a shaft 181 passing therethrough, as shown in FIG. 15, and a handle 182 is arranged at at least one side thereof to facilitate unfolding of the system. In use, the system may be arranged as shown in FIG. 14, and the cable passes over rollers 155, 170 and 180, as shown in FIG. 14.

Various cross-members 190 and 191 are provided for the extension support arms 201, to strengthen the structure of the extension arm 200 and to support the person on the unit during preparation for escape.

FIG. 16 shows the system of FIGS. 14 and 15 with the platform arm and extension arm in the folded condition, so as to render the device extremely compact when not in use. To place the system in use, the platform arm structure 150 is pivoted upwardly in the direction of arrow C in FIG. 16. When the structure is pivoted by more than 180 degrees, (past the upstanding vertical position), pivoting continues and the extension arm structure 200 pivots out from arms 150 by gravity (see FIG. 14). Then, in the position of FIG. 14, the system is ready for use. The handles 172, 182 are provided to facilitate placing the system in the "use" condition of FIG. 14. If the window is further from the unit, the extension arm structure 200 extends out from the window.

The guide member 160 is formed of two pieces with a space 163 between the free ends of the two pieces, as shown in FIG. 10. The cable 125 can be passed through the guide 160, or can be slid into the guide 160 through the space 163.

Grill members may be provided on all surfaces of the device to protect users from danger of the spinning blades 116, and to improve the visual appearance of the device.

In situations where the window is not openable, the platform arms 150, when being pivoted to the operable position (shown in FIGS. 10, 11 and 14), can be used to smash against the window and break the window, thereby providing an opening for escape from the structure. Thus, while opening the platform arm to the use position, the window can be broken to speed up the escape operation if the window is a non-opening window or if an openable window is stuck or difficult to open.

The system of the present invention does not require a window ledge, such as the window ledge shown in FIG. 14.

When a window ledge is not provided, or when the window ledge is lower than the unit itself, then escape can be accomplished when the unit is in the condition shown in FIGS. 10 and 11 where the platform arm structure is pivoted to its operable position and rests on the upper surface of the fan housing.

The rescue systems of the present invention are useful not only for high-rise buildings, but also for boats, control towers, high chimneys, storage tanks and other high structures. The system of the present invention is applicable for escape or evacuation from any or all of these and other high structures. Still further, the systems of the present invention can also be used for evacuation from aircraft such as, for example, helicopters, for example when a helicopter is hovering over a place to which persons or articles are to be evacuated.

The two-piece arm structure shown in FIGS. 14–16 renders the device adaptable to many different escape situations, such as for different heights of windows, different heights of window ledges and lengths of window ledges, and the like.

An advantage of the embodiment of FIGS. 10–16 is that the upper surface of the apparatus is substantially flat and it is easier for a person to mount himself or herself on the top of the device, connect the cable and jump out of the window. The system is also more compact due to the horizontal arrangement of the fan shaft, and operation is safer due to the fact that the cable cartridge is arranged in a position far from the position where the user mounts the equipment for egress through the window.

The fan blades 116 may be inclined slightly, as shown in FIG. 17.

While the invention has been described above with respect to a vertical shaft position (of shafts 17, 114), other shaft positions such as horizontal or any other desired position or orientation can be used. Moreover, instead of a direct drive between the cable cartridge 12 and the fan shaft 17, as shown in FIG. 1, the fan of FIG. 1 can be mounted as the dynamic resistance device 115 as shown in FIG. 8 and a gear transmission or belt-and-pulley transmission can be used (as shown in FIG. 8) between the cable cartridge 12 and the rotatable fan shaft 17.

The dynamic resistance device 115 of FIG. 8 can be a fan such as shown in FIG. 1, coupled to transmission 112, 113, 122, or can take various other forms. For example, the dynamic resistance device 115 can be a rotary vane compressor, such as the oilless rotary vane compressor Model 6066 Series manufactured by Gast Manufacturing Corporation, Benton Harbor, Mich. 49022. Alternatively, a regenerative blower such as REGENAIR® R7 Series, also manufactured by Gast Air Compressors, can be used. If the R7 Series REGENAIR® device is used, a drive motor therefor is not needed, since the drive shaft of the REGENAIR® R7 Series blower will be coupled to the shaft 123 of FIG. 8 to provide the desired rotation and the air resistance. Other dynamic resistance devices, such as those shown in U.S. Pat. No. 3,198,880, U.S. Pat. No. 4,469,196 and U.S. Pat. No. 3,861,496, for example, can be used as the dynamic resistance device 115 of the present invention. The critical factor in the present invention is the removable cartridge configuration to enable quick and easy replacement of the cartridge after each rescue operation so that a large number of people can be rescued in a relatively short period of time and at a relatively low cost.

While the apparatus is shown and described as being used adjacent a window of a building, such as a high-rise building, the apparatus can be used adjacent to a door of a building opening to the outside, or any other opening of a building which enables escape of occupants to the outside of the building. Special openings, or even special break-away wall portions can be used instead of windows. Alternatively, the apparatus can be mounted on a roof or veranda (terrace) of a building.

While the invention has been described above with respect to specific structures, various alterations, modifications and substitutions can be made within the scope of the appended claims.

What is claimed is:

1. A rescue system for rescuing occupants, comprising;

a frame positioned adjacent an open or openable escape portion of a structure, the escape portion being open or openable to the outside or the structure;

an air fan having a substantially horizontal shaft and at least two vanes coupled to the shaft, the shaft being mounted to said frame such that said fan is rotatable relative to said frame;

a removable and replaceable cable cartridge comprising a rotatable housing which is removably coupled to said air fan so as to rotate said air fan upon rotation of said rotatable housing, and said cable cartridge having a cable pre-wound on said rotatable housing, said cable having a free end which is connectable to an occupant to be rescued;

said rotatable housing of said cable cartridge having a substantially horizontal rotation axis when coupled to said air fan; and a guide section for guiding said cable, as it is unwound from said rotatable housing, over said frame and out of the escape portion of the structure;

wherein when the occupant to be rescued goes out from the escape portion of the structure, the descending motion of the occupant to be rescued causes the cable to unwind from said rotatable housing of said cable cartridge and to move over said frame in engagement with said guide section with the same linear speed as the descending speed of the occupant to be rescued, thus causing said rotatable housing to rotate which in turn causes the air fan to rotate and to create air resistance to the descending speed, until the descending speed of the occupant to be rescued reaches a substantially equilibrium value when the resistance force created by the air fan is equal to the gravity force acting on the descending person.

2. The rescue system according to claim 1, wherein said cable guide section comprises a platform arm assembly pivotally connected to said frame so as to be pivotal between a rest position in which the rescue system is out of use, and an operative position in which said platform arm assembly extends over said frame and out of the escape portion of the structure.

3. The rescue system according to claim 2, wherein said guide section further comprises a guide member through which said cable passes during use.

4. The rescue system according to claim 2, wherein said platform arm assembly comprises a first roller at a front side of said frame, and a second roller which extends out of the escape portion of the structure in said operative position, said cable passing over both of said rollers when said platform arm assembly is in said operative position during use.

5. The rescue system according to claim 4, wherein said platform arm assembly further comprises a guide member arranged in the vicinity of said first roller, and through which said cable passes when passing over said first roller during use.

6. The rescue system according to claim 2, wherein said platform assembly comprises:

a first arm assembly pivotally connected to said frame so as to be pivotal between a rest position in which the rescue system is out of use, and an operative position in which said first arm assembly extends over said frame; and a second arm assembly pivotally connected to an end of said first arm assembly and which is pivotal relative to said first arm assembly, in said operative position, to extend out of the escape portion of the structure.

7. A The rescue system according to claim 6, wherein:

said first arm assembly comprises a first roller at a front side of said frame, and a second roller at a free end of said first arm assembly; and said second arm assembly comprises a third roller at a free end of said second arm assembly such that said third roller extends out of the escape portion of the structure in said operative position; and wherein said cable passes over all three of said rollers when said platform arm assembly is in said operative position during use.

8. A The rescue system according to claim 7, wherein said guide section further comprises a guide member through which said cable passes during use.

9. The rescue system according to claim 8, wherein said guide member is arranged in the vicinity of said first roller.

10. The rescue system according to claim 2, wherein said frame has an upper support surface on which said platform arm assembly is supported when in an operative position.

11. A method for rescuing occupants using an apparatus comprising:

a frame positioned adjacent an open or openable escape portion of a structure, the escape portion being open or openable to the outside of the structure; and an air fan having a substantially horizontal shaft and at least two vanes coupled to the shaft, the shaft being mounted to said frame such that said fan is rotatable relative to said frame;

the method comprising the steps of:

(a) providing a plurality of removable and replaceable cable cartridges, each comprising a rotatable housing which has a cable ore-wound on said rotatable housing, said cable having a free end which is connectable to an occupant to be rescued;

(b) removably coupling a cable cartridge to said air fan so as to rotate said air fan upon rotation of said rotatable housing;

said rotatable housing of said cable cartridge having a substantially horizontal rotation axis when coupled to said air fan;

(c) connecting said free end of said cable to the occupant to be rescued;

(d) guiding said cable by a guide section, as it is unwound from said rotatable housing, over said frame and out of the escape portion of the structure; and (e) causing the occupant to be rescued to go out from the escape portion of the structure, whereby the descending motion of the occupant to be rescued causes the cable to unwind from said rotatable housing of said cable cartridge and to move over said frame in engagement with said guide section with the same linear speed as the descending speed of the occupant to be rescued, thus causing said rotatable housing to rotate which in turn causes the air fan to rotate and to create air resistance to the descending speed, until the descending speed of the occupant to be rescued reaches a substantially equilibrium value when the resistance force created by the air fan is equal to the gravity force acting on the descending person.

12. The rescue method according to claim 11, wherein said guide section comprises a platform arm assembly pivotally connected to said frame, the method further comprising pivoting said platform arm assembly from a rest position in which the apparatus is out of use, and an operative position in which said platform arm assembly extends over said frame and out of the escape portion of the building.

13. The rescue method according to claim 12, wherein said guiding step comprises passing said cable through a guide member during use.

14. The rescue method according to claim 12, wherein said guiding step comprises passing said cable over a first roller at a front side of said frame, and over a second roller which extends out of the escape portion of the structure in said operative position during use.

15. The rescue method according to claim 14, wherein said guiding step comprises passing said cable through a guide member arranged in the vicinity of said first roller during use.

16. The rescue method according to claim 12, wherein said platform assembly comprises:

a first arm assembly pivotally connected to said frame so as to be pivotal between a rest position in which the apparatus is out of use, end an operative position in which said first arm assembly extends over said frame; and a second arm assembly pivotally connected to an end of said first arm assembly and which is pivotal relative to said first arm assembly, in said operative position, to extend out of the escape portion of the structure;

wherein the method further comprises the step of:

passing said cable over said first and second arm assemblies.

17. The rescue method according to claim 16, wherein:

said first arm assembly comprises a first roller at a front side of said frame, and a second roller at a free end of said first arm assembly; and said second arm assembly comprises a third roller at a free end of said second arm assembly such that said third roller extends out of the escape portion of the structure in said operative position; and wherein the method further comprises passing said cable over all three of said rollers when said platform arm assembly is in said operative position during use.

18. The rescue method according to claim 17, wherein said guiding step comprises passing said cable through a guide member during use.

19. The rescue method according to claim 18, comprising arranging said guide member in the vicinity of said first roller.

20. The rescue method according to claim 12, further comprising supporting said platform arm assembly on an upper support surface of said frame when said platform arm assembly is in said operative position.

* * * * *